US011993861B2

(12) United States Patent
Tsuji

(10) Patent No.: US 11,993,861 B2
(45) Date of Patent: May 28, 2024

(54) PLATING APPARATUS AND AIR BUBBLE REMOVING METHOD

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 73 days.

(21) Appl. No.: 17/627,576

(22) PCT Filed: Mar. 10, 2021

(86) PCT No.: PCT/JP2021/009474
§ 371 (c)(1),
(2) Date: Jan. 14, 2022

(87) PCT Pub. No.: WO2022/190242
PCT Pub. Date: Sep. 15, 2022

(65) Prior Publication Data

US 2023/0151508 A1 May 18, 2023

(51) Int. Cl.
*C25D 21/04* (2006.01)
*C25D 17/06* (2006.01)
*C25D 21/10* (2006.01)

(52) U.S. Cl.
CPC ..... *C25D 21/04* (2013.01); *C25D 17/06* (2013.01); *C25D 21/10* (2013.01)

(58) Field of Classification Search
None
See application file for complete search history.

(56) References Cited

U.S. PATENT DOCUMENTS

2019/0338440 A1* 11/2019 Banik ..... C25D 21/14

FOREIGN PATENT DOCUMENTS

| | | | |
|---|---|---|---|
| JP | S51-044568 | A | 4/1976 |
| JP | H06-128791 | A | 5/1994 |
| JP | H11-229192 | A | 8/1999 |
| JP | 2004-363422 | A | 12/2004 |

(Continued)

*Primary Examiner* — Stefanie S Wittenberg
(74) *Attorney, Agent, or Firm* — BakerHostetler

(57) ABSTRACT

Provided is a technique that allows a removal of air bubbles that remain on an ionically resistive element.
A plating apparatus 1000 includes a plating tank 10 configured to accumulate a plating solution Ps and including an ionically resistive element 12 arranged in the plating tank, a substrate holder 30 arranged above the ionically resistive element and configured to hold a dummy substrate Wfx, a rotation mechanism 40 configured to rotate the substrate holder, and an elevating mechanism 50 configured to elevate the substrate holder. At least one projecting portion is disposed on a lower surface of the dummy substrate. The at least one projecting portion 60 projects downward from the lower surface. The substrate holder includes a ring 31 projecting below an outer peripheral edge of the lower surface of the dummy substrate. The projecting portion has a lower surface positioned below a lower surface of the ring. The plating apparatus is configured to cause the rotation mechanism to rotate the substrate holder in a state where the elevating mechanism moves down the substrate holder to allow the projecting portion of the dummy substrate to be positioned above the ionically resistive element and to be immersed in the plating solution of the plating tank.

13 Claims, 15 Drawing Sheets

(56) References Cited

FOREIGN PATENT DOCUMENTS

| | | | |
|---|---|---|---|
| JP | 2006-265738 | A | 10/2006 |
| JP | 2008-019496 | A | 1/2008 |
| KR | 2020-0139839 | A | 12/2020 |
| WO | WO 2019/212930 | A1 | 11/2019 |

* cited by examiner

PLATING APPARATUS AND AIR BUBBLE REMOVING METHOD

TECHNICAL FIELD

The present invention relates to a plating apparatus and an air bubble removing method.

BACKGROUND ART

Conventionally, there has been known what is called a cup type plating apparatus as a plating apparatus that can perform a plating process on a substrate (for example, see PTL 1). Such a plating apparatus includes a plating tank that accumulates a plating solution, a substrate holder that holds a substrate as a cathode, a rotation mechanism that rotates the substrate holder, and an elevating mechanism that elevates the substrate holder.

Further, conventionally, there has been known, for example, a technique of arranging a porous ionically resistive element inside the plating tank to ensure in-plane uniformity of a film thickness of the plating film (for example, see PTL 2).

CITATION LIST

Patent Literature

PTL 1: Japanese Unexamined Patent Application Publication No. 2008-194%

PTL 2: Japanese Unexamined Patent Application Publication No. 2004-363422

SUMMARY OF INVENTION

Technical Problem

In the cup type plating apparatus as exemplified above in PTL 1, for example, in a case where the ionically resistive element as exemplified in PTL 2 is arranged inside the plating tank, air bubbles contained in the plating solution in the plating tank possibly remain on the ionically resistive element (specifically, on a lower surface of the ionically resistive element and in holes of the ionically resistive element). In a case where the plating process is performed on the substrate in a state where the air bubbles remain on the ionically resistive element, the remaining air bubbles may possibly deteriorate a plating quality of the substrate.

The present invention has been made in view of the above, and one of the objects of the present invention is to provide a technique that can remove air bubbles that remain on the ionically resistive element.

Solution to Problem

[Aspect 1] To achieve the above-described object, a plating apparatus according to one aspect of the present invention includes a plating tank, a substrate holder, a rotation mechanism, and an elevating mechanism. The plating tank is configured to accumulate a plating solution and includes a porous ionically resistive element arranged in the plating tank. The substrate holder is arranged above the ionically resistive element and configured to hold a dummy substrate. The rotation mechanism is configured to rotate the substrate holder. The elevating mechanism is configured to elevate the substrate holder. At least one projecting portion is disposed on a lower surface of the dummy substrate, the at least one projecting portion projecting downward from the lower surface. The substrate holder includes a ring projecting below an outer peripheral edge of the lower surface of the dummy substrate. The projecting portion has a lower surface positioned below a lower surface of the ring. The plating apparatus is configured to cause the rotation mechanism to rotate the substrate holder in a state where the elevating mechanism moves down the substrate holder to allow the projecting portion of the dummy substrate to be positioned above the ionically resistive element and the projecting portion to be immersed in the plating solution of the plating tank.

With this aspect, in a case where the projecting portion of the dummy substrate immersed in the plating solution rotates, air bubbles on a lower surface and inside holes of the ionically resistive element can be suctioned using a pressure difference generated in a peripheral area of the projecting portion of the dummy substrate. Thus, the air bubbles that remain on the ionically resistive element can be removed.

[Aspect 2] In Aspect 1 described above, a space may be formed between the projecting portion and the ring such that the projecting portion does not contact the ring.

[Aspect 3] In Aspect 1 or Aspect 2 described above, the projecting portion has a projection height from the lower surface of the dummy substrate, the projecting height may be a value selected within a range of 1 mm or more and 100 mm or less.

With this aspect, a difficulty of transferring the dummy substrate due to the projection height of the projecting portion being excessively high can be suppressed, while a decrease of a removal effect of the air bubbles by the dummy substrate due to the projection height of the projecting portion being excessively low can also be suppressed. That is, the air bubbles that remain on the ionically resistive element can be sufficiently removed, while ensuring facilitated transfer of the dummy substrate.

[Aspect 4] In any one of Aspects 1 to 3 described above, the projecting portion may extend in a radial direction of the lower surface of the dummy substrate.

[Aspect 5] In Aspect 4 described above, the projecting portion may have a curved portion curved in a circumferential direction of the dummy substrate in at least a part of the projecting portion.

[Aspect 6] In any one of Aspects 1 to 3 described above, the projecting portion may include a first portion extending in a radial direction of the lower surface of the dummy substrate from a center of the lower surface of the dummy substrate toward the outer peripheral edge of the lower surface of the dummy substrate, and a second portion connected to an end portion on the outer peripheral edge side of the first portion and inclined with respect to the first portion.

[Aspect 7] In any one of Aspects 1 to 3 described above, when the lower surface of the dummy substrate is divided by a plurality of virtual concentric circles, at least one projecting portion may be disposed in each region divided by the plurality of virtual concentric circles.

[Aspect 8] In any one of Aspects 1 to 7 described above, the substrate holder may be configured to hold a substrate in a plating process to perform a plating process on the substrate and hold the dummy substrate during an air bubble removal to remove air bubbles that remain on the ionically resistive element, and the elevating mechanism may be configured to position the substrate holder during the air bubble removal above a position of the substrate holder in the plating process.

With this aspect, the projecting portion of the dummy substrate can be easily ensured to not contact the ionically resistive element during the air bubble removal.

[Aspect 9] In any one of Aspects 1 to 8 described above, when the elevating mechanism immerses the projecting portion of the dummy substrate in the plating solution of the plating tank, a part of the lower surface of the dummy substrate where the projecting portion is not disposed may also be immersed in the plating solution of the plating tank.

With this aspect, compared with a case where the area of the lower surface of the dummy substrate where the projecting portion is not disposed is not immersed in the plating solution, in a case where the projecting portion rotates according to the rotation of the substrate holder, a cause of wave on a liquid surface of the plating solution in the plating tank can be suppressed. Thus, a cause of a liquid splash of the plating solution in the plating tank can be suppressed.

[Aspect 10] To achieve the above-described object, an air bubble removing method according to one aspect of the present invention is an air bubble removing method of removing air bubbles that remain on a porous ionically resistive element of a plating tank configured to accumulate a plating solution and including the ionically resistive element arranged in the plating tank. The air bubble removing method includes causing a substrate holder to hold a dummy substrate having a lower surface provided with at least one projecting portion projecting downward, moving down the substrate holder holding the dummy substrate and immersing the projecting portion in the plating solution of the plating tank in a state where the projecting portion is positioned above the ionically resistive element, and rotating the substrate holder in a state where the projecting portion of the dummy substrate is positioned above the ionically resistive element and is immersed in the plating solution of the plating tank. The substrate holder includes a ring projecting below an outer peripheral edge of the lower surface of the dummy substrate, and the lower surface of the projecting portion is positioned below a lower surface of the ring.

With this aspect, the air bubbles that remain on the ionically resistive element can be removed.

DESCRIPTION OF EMBODIMENTS

[Embodiment] The following will describe an embodiment of the present invention with reference to the drawings. Note that, in the following embodiment and modifications of the embodiment, identical reference signs are assigned for identical or corresponding configurations, and their descriptions may be appropriately omitted. Further, the drawings are schematically illustrated to facilitate understanding of the features of constituent elements, and dimensional proportions and the like of each constituent element are not necessarily the same as the actual ones. Further, in some drawings, orthogonal coordinates of X-Y-Z are illustrated for reference. Of the orthogonal coordinates, the Z direction corresponds to an upper side, and the −Z direction corresponds to a lower side (direction in which gravity acts).

Figure 1:
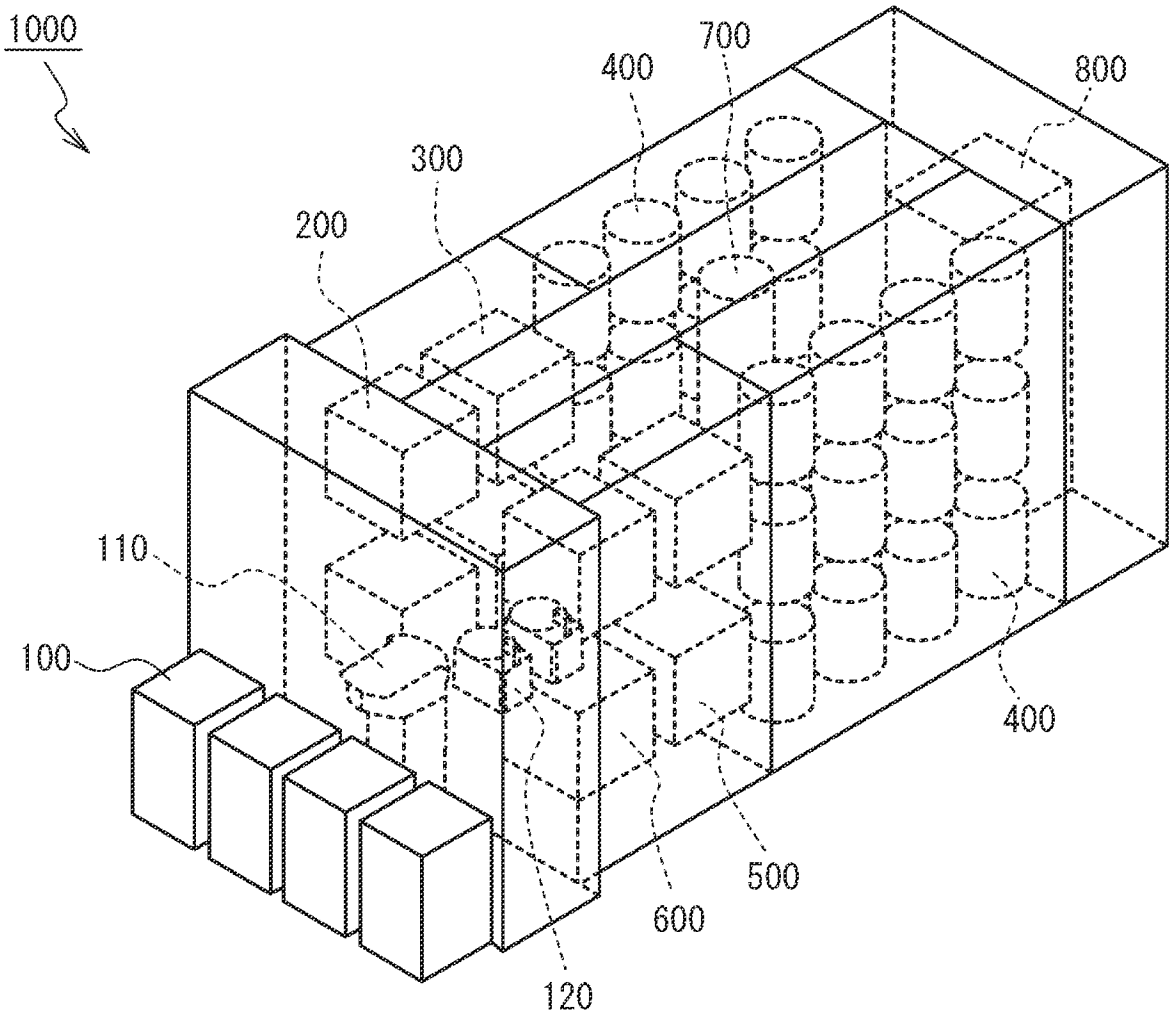
FIG. 1 is a perspective view illustrating an overall configuration of a plating apparatus according to this embodiment.
Figure 2:
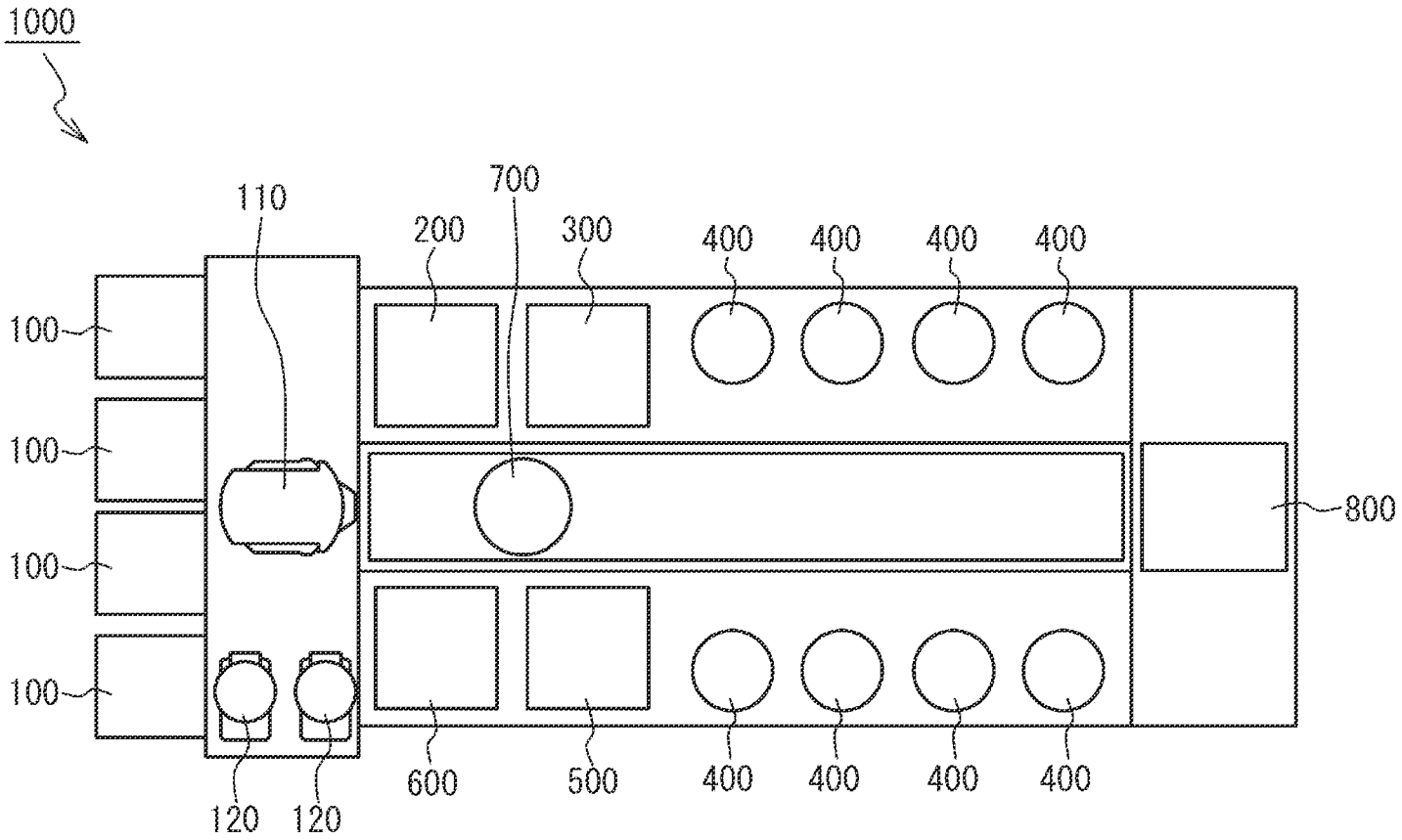
FIG. 2 is a plan view illustrating the overall configuration of the plating apparatus according to this embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating modules 400 will be described. Since the plurality of plating modules 400 included in the plating apparatus 1000 according to this embodiment have the identical configuration, one of the plating modules 400 will be described.

Figure 3:
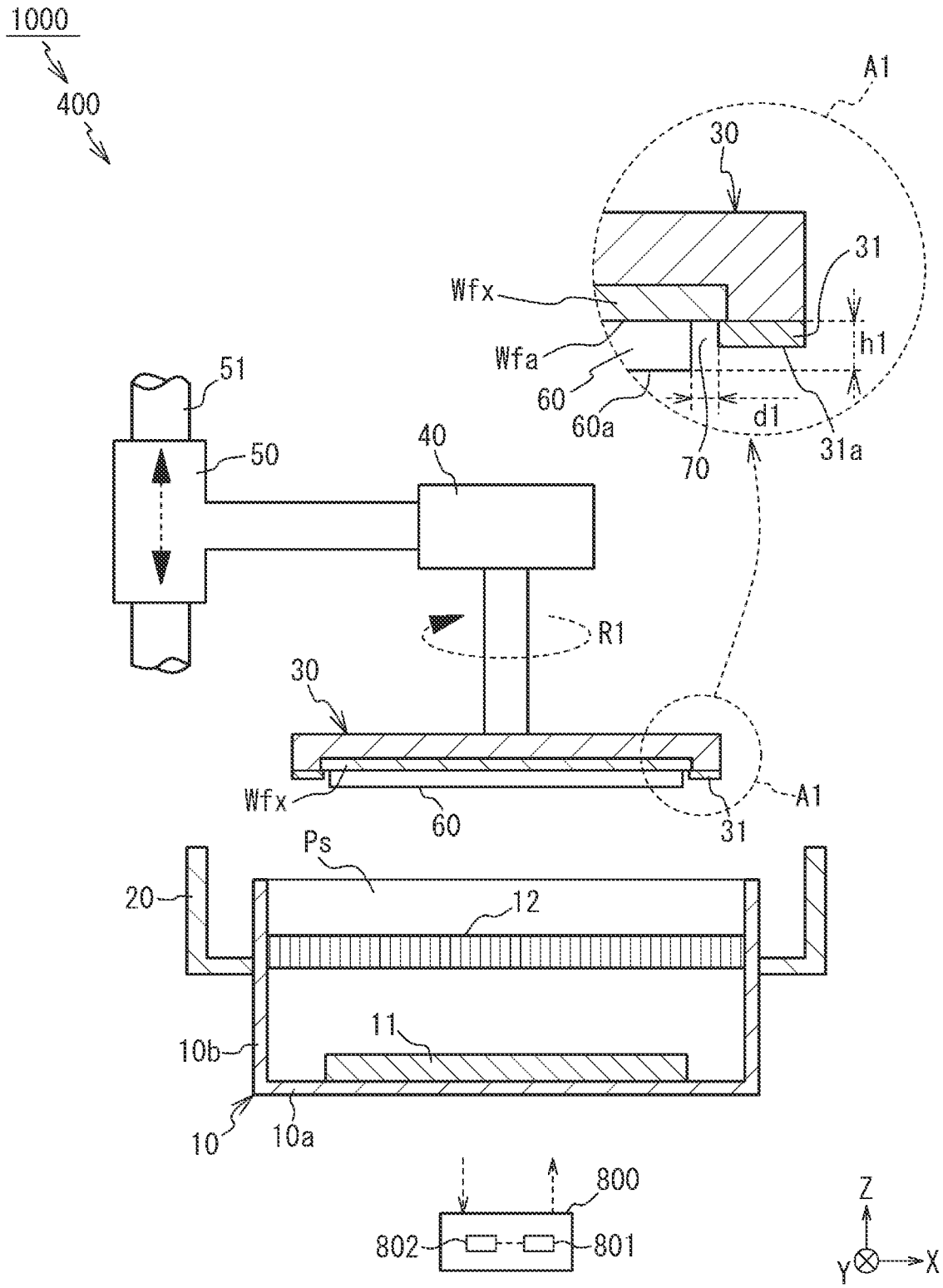
FIG. 3 is a schematic diagram illustrating a configuration of a plating module in the plating apparatus according to this embodiment.

FIG. 3 is a schematic diagram illustrating the configuration of the plating module 400 in the plating apparatus 1000 of this embodiment. Specifically, FIG. 3 schematically illustrates the plating module 400 in a state before the air bubble removal described later is performed. The plating apparatus 1000 according to this embodiment is a cup type plating apparatus. The plating module 400 of the plating apparatus 1000 includes a plating tank 10, an overflow tank 20, a substrate holder 30, a rotation mechanism 40, and an elevating mechanism 50.

The plating tank 10 according to this embodiment is configured of a container with a bottom having an opening on an upper side. Specifically, the plating tank 10 has a bottom wall 10*a* and an outer peripheral wall 10*b* extending upward from an outer peripheral edge of the bottom wall 10*a*, and an upper portion of the outer peripheral wall 10*b* is open. Note that, although the shape of the outer peripheral wall 10*b* of the plating tank 10 is not particularly limited, the outer peripheral wall 10*b* according to this embodiment has a cylindrical shape as an example. Inside of the plating tank 10, a plating solution Ps is accumulated. Furthermore, the plating tank 10 includes a supply port (not illustrated) for supplying the plating solution Ps to the plating tank 10.

It is only necessary for the plating solution Ps to be a solution including an ion of a metallic element constituting a plating film, and a specific example of the plating solution Ps is not particularly limited. In this embodiment, a copper plating process is used as an example of the plating process, and a copper sulfate solution is used as an example of the plating solution Ps. Further, in this embodiment, a predetermined additive is included in the plating solution Ps. However, the configuration of the plating solution Ps is not limited to this, and the plating solution Ps can be configured not to include an additive.

In the inside of the plating tank 10, an anode 11 is arranged. Specifically, the anode 11 according to this embodiment is arranged on the bottom wall 10*a* of the plating tank 10 as an example. The specific type of the anode 11 is not particularly limited, and the anode 11 may be an insoluble anode or may be a soluble anode. In this embodiment, the insoluble anode is used as an example of the anode 11. The specific type of the insoluble anode is not particularly limited, and platinum, iridium oxide, and the like can be used.

Figure 4:
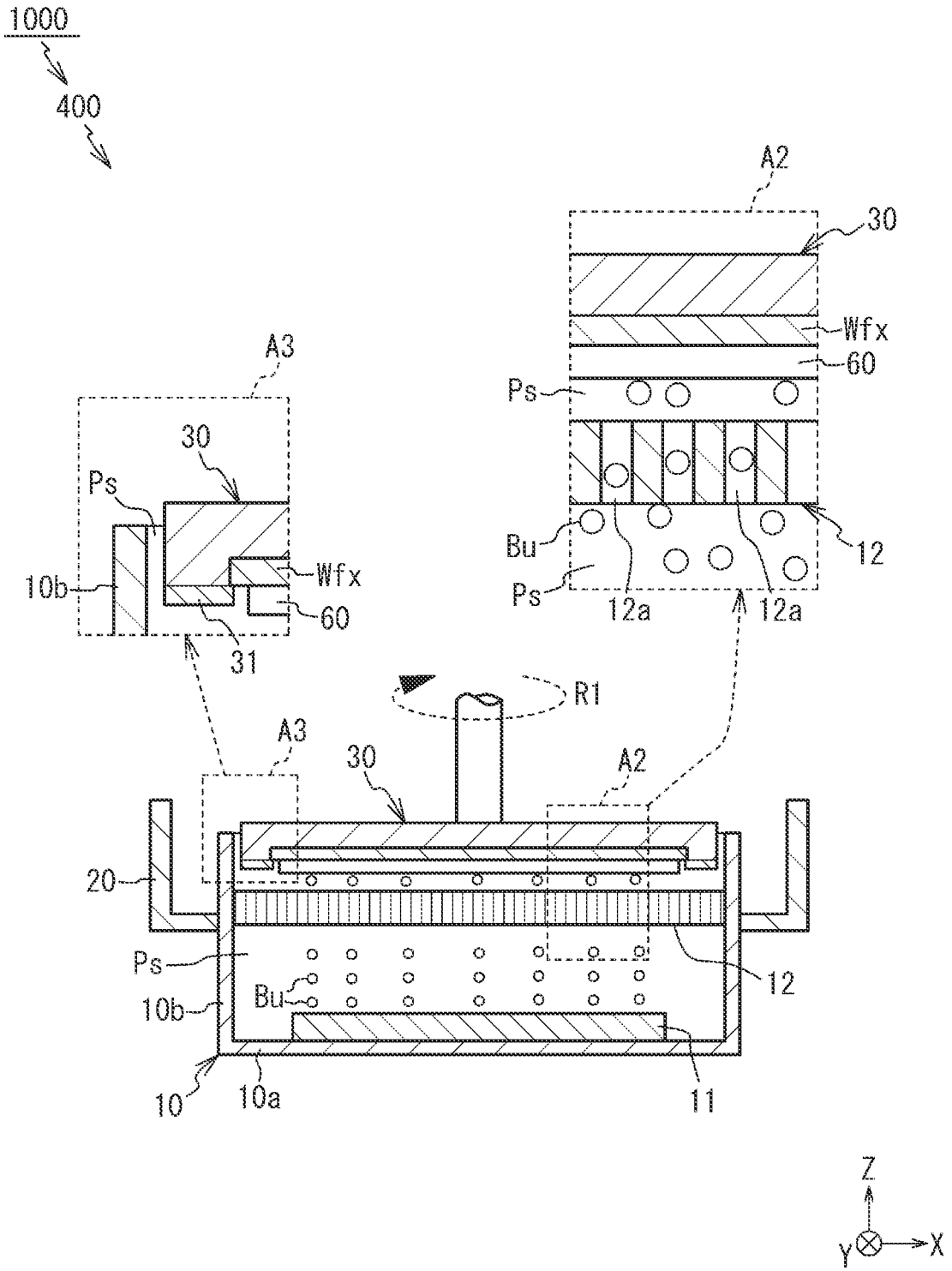
FIG. 4 is a schematic cross-sectional view illustrating a state where a dummy substrate is immersed in a plating solution during an air bubble removal according to this embodiment.
Figure 5:
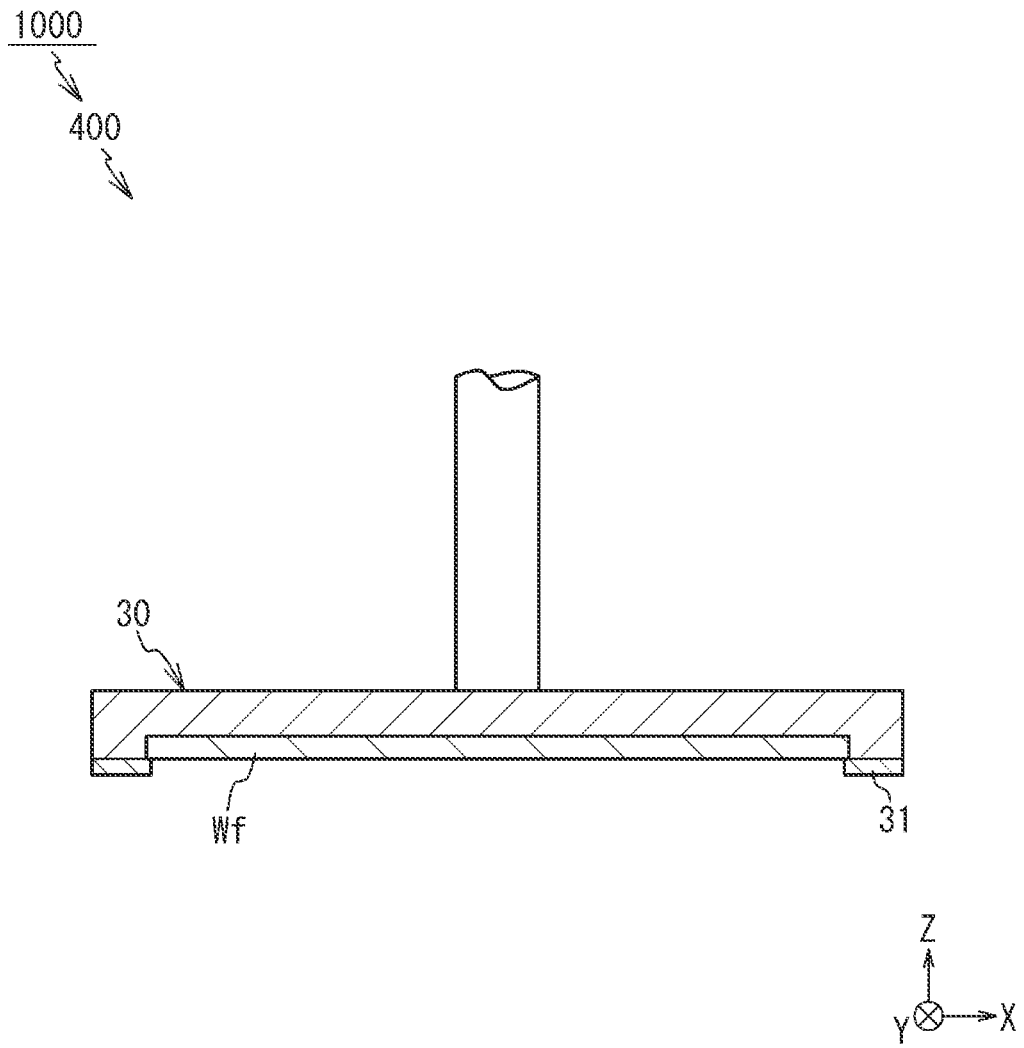
FIG. 5 is a cross-sectional view schematically illustrating a state where a substrate holder according to this embodiment holds a substrate as a cathode.

In the inside of the plating tank 10, a porous ionically resistive element 12 is arranged above the anode 11. Specifically, the ionically resistive element 12 is configured of a porous plate member having a plurality of holes 12*a* (pores) (Note that the reference numeral of the hole 12*a* is illustrated in FIG. 4 described later). The holes 12*a* of the ionically resistive element 12 according to this embodiment are through-holes disposed to communicate the lower surface and the upper surface of the ionically resistive element 12. The ionically resistive element 12 is a member disposed for ensuring homogenization of an electric field formed between the anode 11 and the substrate Wf as a cathode (the reference numeral is illustrated in FIG. 5 described later). Thus, by arranging the ionically resistive element 12 in the plating tank 10, homogenization of a film thickness of the plating film (plated layer) formed on the substrate Wf can be easily ensured.

The overflow tank 20 is configured of a container with a bottom arranged outside the plating tank 10. The overflow tank 20 is a tank disposed for temporarily accumulating the plating solution Ps exceeding an upper end of the outer peripheral wall 10*b* of the plating tank 10 (that is, the plating solution Ps overflowing from the plating tank 10). The plating solution Ps temporarily accumulated in the overflow tank 20 is discharged from a discharge port (not illustrated) for the overflow tank 20, and afterwards, is temporarily accumulated in a reservoir tank (not illustrated) for the overflow tank 20. The plating solution Ps accumulated in the reservoir tank is then pressure fed by a pump (not illustrated) and circulated to the plating tank 10 again from the supply port for the plating solution.

FIG. 4 is a schematic cross-sectional view illustrating a state where the dummy substrate Wfx described later is immersed in the plating solution Ps during the air bubble removal. FIG. 5 is a cross-sectional view schematically illustrating a state where the substrate holder 30 holds the substrate Wf as the cathode. With reference to FIG. 3, FIG. 4, and FIG. 5, the substrate holder 30 is disposed above the ionically resistive element 12.

As illustrated in FIG. 5, in the "plating process" to perform a plating process on the substrate Wf, the substrate holder 30 holds the substrate Wf (that is, the substrate Wf on which the plating process is performed) such that the lower surface (surface to be plated) of the substrate Wf is opposed to the ionically resistive element 12.

Meanwhile, as illustrated in FIG. 3 and FIG. 4, in the "air bubble removal" to remove the air bubbles that remain on the ionically resistive element 12, the substrate holder 30 holds, instead of the substrate Wf, the dummy substrate Wfx such that the lower surface Wfa of the dummy substrate Wfx on which the plating process is not performed is opposed to the ionically resistive element 12. That is, the substrate holder 30 according to this embodiment is configured to selectively hold the substrate Wf on which the plating process is performed and the dummy substrate Wfx on which the plating process is not performed.

With reference to particularly the enlarged view of the A1 part in FIG. 3, the substrate holder 30 according to this embodiment includes a ring 31 disposed to be projected below the outer peripheral edge of the lower surface Wfa (and the lower surface of the substrate Wf) of the dummy substrate Wfx. This ring 31 has a ring shape in a bottom view.

Note that a sealing member for suppressing an invasion of the plating solution Ps into a gap between the substrate holder 30 and the dummy substrate Wfx may be disposed between the substrate holder 30 and the dummy substrate Wfx. That is, in this case, the substrate holder 30 holds the dummy substrate Wfx via the sealing member. Examples of the material of the sealing member include fluorine-containing rubber (FKM), or the like.

With reference to FIG. 3, the substrate holder 30 is connected to the rotation mechanism 40. The rotation mechanism 40 is a mechanism for rotating the substrate holder 30. "R1" exemplified in FIG. 3 is an exemplary rotation direction of the substrate holder 30. For the rotation mechanism 40, a known mechanism can be used, such as a rotation motor. The elevating mechanism 50 is supported by a spindle 51 extending in a vertical direction. The elevating mechanism 50 is a mechanism for moving up and down the substrate holder 30 and the rotation mechanism 40. For the elevating mechanism 50, a known elevating mechanism can be used, such as a linear motion type actuator.

An operation of the plating module 400 is controlled by the control module 800. The control module 800 includes a microcomputer. The microcomputer includes a Central Processing Unit (CPU) 801 as a processor, a storage device 802 as a non-transitory storage medium, and the like. The control module 800 controls an operation of a controlled unit of the plating module 400 (such as the rotation mechanism 40 and the elevating mechanism 50) according to the CPU 801 operating as a processor based on commands of a program stored in a storage device 802.

Incidentally, in the plating apparatus 1000, for some reason, air bubbles (Bu) are generated in the plating solution Ps of the plating tank 10 in some cases. Specifically, in a case where the insoluble anode is used as the anode 11 as in this embodiment, oxygen ($O_2$) is generated in the plating solution Ps based on the following reaction equation in a plating process of the substrate Wf (that is, when applying current). In this case, the generated oxygen possibly becomes the air bubbles.

$$2H_2O \rightarrow O_2 + 4H^+ + 4e^-$$

Further, in a case where the soluble anode is provisionally used as the anode 11, a reaction equation as described above does not occur. However, for example, when the plating solution Ps is first introduced into the plating tank 10, air may possibly flow into the plating tank 10 together with the plating solution Ps. Accordingly, even in a case where the soluble anode is used as the anode 11, air bubbles may possibly be generated in the plating solution Ps of the plating tank 10.

As described above, in a case where air bubbles are generated in the plating solution Ps of the plating tank 10, the air bubbles sometimes remain on the lower surface of the ionically resistive element 12 and in the holes 12*a* of the ionically resistive element 12. When the plating process is performed on the substrate Wf in the above state, a plating quality of the substrate Wf may possibly deteriorate due to the remaining air bubbles. Therefore, in this embodiment, the following technique is used to deal with the problem.

Figure 6:
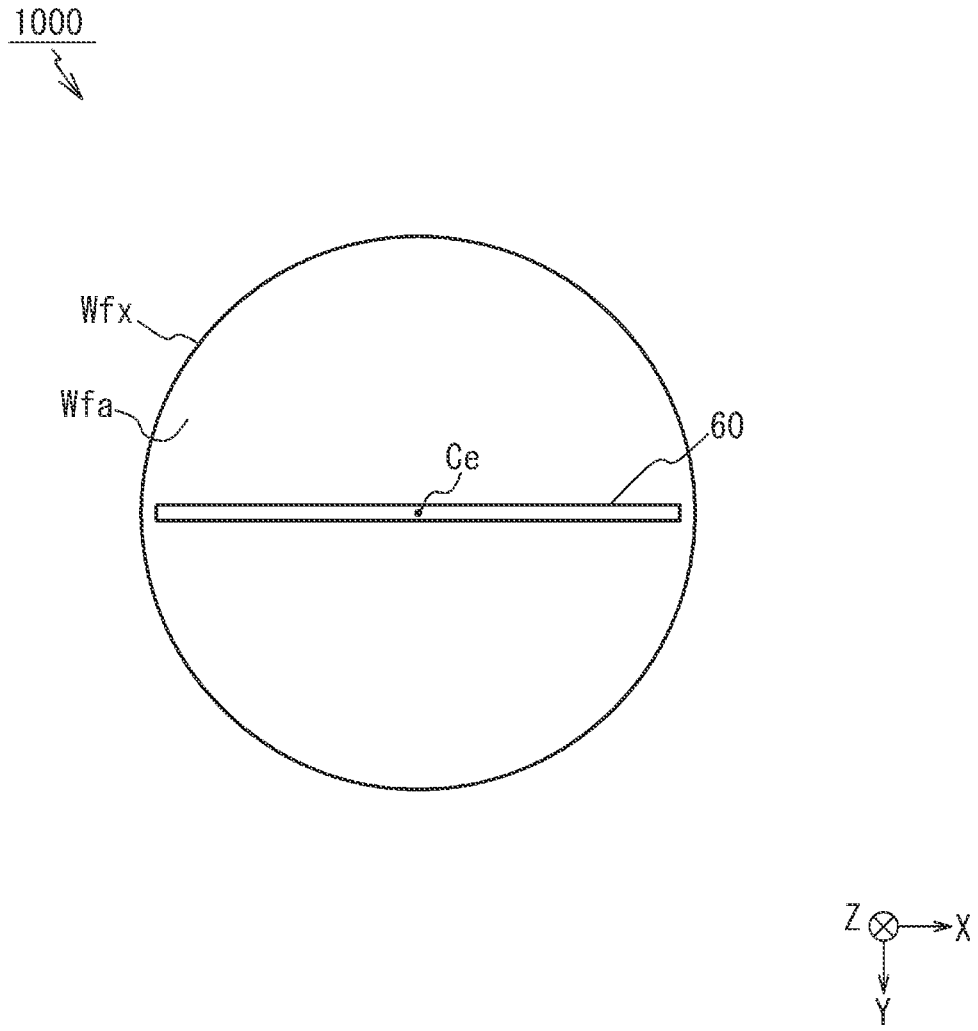
FIG. 6 is a schematic bottom view of a dummy substrate according to this embodiment.

First, a description will be given of the dummy substrate Wfx. FIG. 6 is a schematic bottom view illustrating a state of the dummy substrate Wfx viewed from a lower side. With reference to FIG. 3 and FIG. 6, the dummy substrate Wfx is a substrate held by the substrate holder 30 instead of the substrate Wf during the air bubble removal. In this embodiment, an outer peripheral edge of the lower surface Wfa of the dummy substrate Wfx has a circular shape.

At least one projecting portion 60 projecting downward from the lower surface Wfa is disposed on the lower surface Wfa of the dummy substrate Wfx. That is, a number of the projecting portion 60 may be one or may be plural. This embodiment includes one projecting portion 60 as an example.

The projecting portion 60 is configured to suction the air bubbles (that is, air bubbles that remain on the ionically resistive element 12) on the lower surface and inside the holes 12*a* of the ionically resistive element 12 using a pressure difference generated in a peripheral area of the projecting portion 60 of the dummy substrate Wfx while the substrate holder 30 rotates in a state where the projecting portion 60 is immersed in the plating solution Ps. Specifically, in a case where the substrate holder 30 rotates in a state where the projecting portion 60 is immersed in the plating solution Ps, a back side in a rotation direction (that is, a side opposite to the rotation direction) of the projecting portion 60 becomes negative pressure. By using this negative pressure, the air bubbles that remain on the ionically resistive element 12 can be suctioned upward.

Specifically, the projecting portion 60 according to this embodiment is configured to extend in a predetermined direction along the lower surface Wfa of the dummy substrate Wfx More specifically, the projecting portion 60 according to the embodiment extends in a radial direction of the lower surface Wfa of the dummy substrate Wfx.

In more detail, the projecting portion 60 according to the embodiment extends toward one side and another side in a radial direction from a center Ce of the lower surface Wfa of the dummy substrate Wfx (in other words, the projecting portion 60 extends in a diametral direction of the lower surface Wfa of the dummy substrate Wfx).

Further, with reference to the enlarged view of an A1 part in FIG. 3, the projecting portion 60 according to the embodiment has a space 70 from an inner peripheral surface of the ring 31 of the substrate holder 30 such that the projecting portion 60 does not contact the ring 31.

A specific value of a length of the space 70, that is a distance (d1) between the projecting portion 60 and the ring 31, is not particularly limited. But, as an example of the numerical value, a value selected within a range of larger than 0 mm and 1 mm or less can be used. That is, the distance (d) satisfies 0 mm<d1≤1 mm in the embodiment.

With this configuration, compared with a case where the distance (d1) between the projecting portion 60 and the ring 31 is larger than 1 mm, the air bubbles that remain in a proximity of the outer peripheral edge of the ionically resistive element 12 can be effectively suctioned upward, since the projecting portion 60 extends to the proximity of the outer peripheral edge of the lower surface Wfa of the dummy substrate Wfx.

Further, with reference to the enlarged view of the A1 part in FIG. 3, a lower surface 60*a* of the projecting portion 60 according to this embodiment is positioned below a lower surface 31*a* of the ring 31, in a state where the dummy substrate Wfx is held by the substrate holder 30. In other words, the projecting portion 60 according to the embodiment is projected below the ring 31.

A projection height (h1) of the projecting portion 60 from the lower surface Wfa of the dummy substrate Wfx is not particularly limited, but in this embodiment a value selected within a range of 1 mm or more and 100 mm or less is used.

With this configuration, a difficulty of transferring the dummy substrate Wfx due to the projection height (h1) of the projecting portion 60 being excessively high can be suppressed, while a decrease of a removal effect of the air bubbles by the dummy substrate Wfx described later due to the projection height (h1) of the projecting portion 60 being excessively low can also be suppressed. That is, with this configuration, an ease of transfer of the dummy substrate Wfx can be ensured, while the air bubbles that remain on the ionically resistive element 12 can be sufficiently removed.

Note that, as a preferred example of the numerical value of the projection height (h1) of the projecting portion 60 described above, a value selected within a range of 3 mm or more and 50 mm or less is preferred. Specifically, a value selected within a range of 5 mm or more and 20 mm or less is more preferred, and 10 mm is even more preferred. In this embodiment, 10 mm is used as a specific example of the projection height (h1).

Further, a paddle for agitating the plating solution Ps may be arranged between the projecting portion 60 and the ionically resistive element 12, and the plating solution Ps may be agitated by the paddle.

Materials of the dummy substrate Wfx and the projecting portion 60 are not particularly limited, but for example, resin, metal, glass, silicon, or a combination of these, and the like may be used.

Further, in a case where metal is used as the materials of the dummy substrate Wfx and the projecting portion 60, resin may be coated on the surfaces of the dummy substrate Wfx and the projecting portion 60 made of metal. With this configuration, metal components of the dummy substrate Wfx and the projecting portion 60 dissolve in the plating solution Ps, allowing a contamination of the plating solution Ps to be effectively suppressed.

A manufacturing method of the dummy substrate Wfx is not particularly limited, but the following manufacturing method may be used as an example. Specifically, a substrate having a flat lower surface on which the projecting portion 60 is not formed is prepared, and by cutting the lower surface of the prepared substrate, the projecting portion 60 is formed on the lower surface. Accordingly, the dummy substrate Wfx can be manufactured. That is, in this case, the projecting portion 60 and the portion other than the projecting portion 60 (that is, a "main body of the dummy substrate") of the dummy substrate Wfx are formed integrally in the dummy substrate Wfx by the cutting work.

Alternatively, by preparing the projecting portion 60 in advance, and joining the prepared projecting portion 60 to the lower surface of a substrate having a flat lower surface (that is, the main body of the dummy substrate), the dummy substrate Wfx having a projecting portion 60 on the lower surface Wfa can be manufactured.

Figure 7:
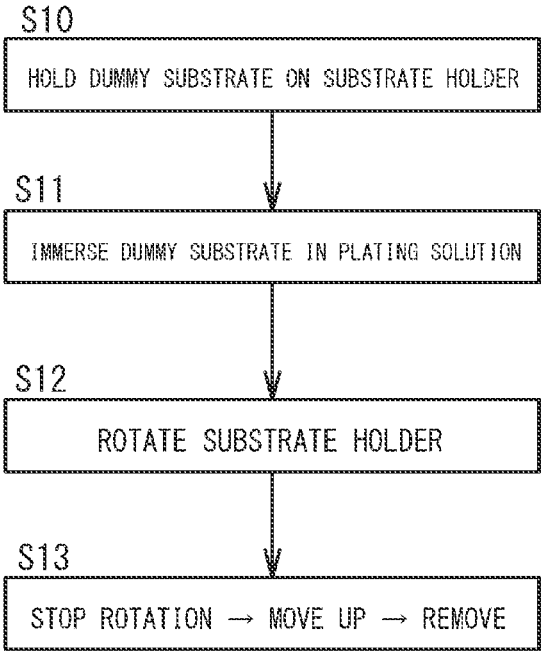
FIG. 7 is a flowchart illustrating an exemplary air bubble removing method according to this embodiment.

FIG. 7 is a flowchart illustrating an exemplary air bubble removing method of the plating apparatus 1000 according to this embodiment. The flowchart is performed during the air bubble removal of the air bubbles that remain on the ionically resistive element 12. Note that a specific performance timing of the air bubble removal (that is, a specific timing to perform the flowchart of FIG. 7) is not particularly limited, but for example, the air bubble removal may be performed when the plating solution Ps is first introduced into the plating tank 10. Alternatively, the air bubble removal may be performed after the plating process is performed on the substrate Wf. As a specific example, the air bubble removal may be performed after the plating process on the substrate Wf has been performed for a predetermined number of times. Alternatively, the air bubble removal may be performed during a maintenance of the plating apparatus 1000 by, for example, a user causing the substrate holder 30 to hold the dummy substrate Wfx.

First, in step S10, the dummy substrate Wfx is held by the substrate holder 30 such that the lower surface Wfa of the dummy substrate Wfx is opposed to the ionically resistive element 12. In this case, the dummy substrate Wfx may be transferred to a location of the substrate holder 30 by a method similar to the transfer method of the substrate Wf. Specifically, the dummy substrate Wfx placed in a "predetermined placement location" may be transferred to a location of the substrate holder 30 by a transfer mechanism (which includes the transfer robot 110 and the transfer device 700 described above).

Further, in this case, some of the four load ports 100 exemplified in FIG. 1 and FIG. 2 may be used as the "predetermined placement location." Alternatively, a load port exclusive for the dummy substrate Wfx may be disposed separately from the four load ports 100, and this may be used as the "predetermined placement location."

After the step S10, the projecting portion 60 of the dummy substrate Wfx is immersed in the plating solution Ps of the plating tank 10 (step S11). In this embodiment, as exemplified in FIG. 4, by moving down the substrate holder 30 using the elevating mechanism 50, the projecting portion 60 is immersed in the plating solution Ps of the plating tank 10. Further, at this point, the elevating mechanism 50 immerses the projecting portion 60 in the plating solution Ps in a state where the projecting portion 60 is positioned a predetermined distance above the ionically resistive element 12, such that the projecting portion 60 of the dummy substrate Wfx does not contact the ionically resistive element 12.

Further, as exemplified in the enlarged view of an A3 part in FIG. 4, when the projecting portion 60 of the dummy substrate Wfx is immersed in the plating solution Ps, the elevating mechanism 50 according to this embodiment immerses not only the projecting portion 60 but also the part of the lower surface Wfa of the dummy substrate Wfx where the projecting portion 60 is not disposed in the plating solution Ps. That is, the part other than the projecting portion 60 of the lower surface Wfa of the dummy substrate Wfx is also positioned below a liquid surface of the plating solution Ps during the air bubble removal of the dummy substrate Wfx according to the embodiment.

With this configuration, compared with a case where the part of the lower surface Wfa of the dummy substrate Wfx where the projecting portion 60 is not disposed is not immersed in the plating solution Ps (see FIG. 8 according to Modification 1 described below), in a case where the projecting portion 60 rotates according to the rotation of the substrate holder 30, the projecting portion 60 suppresses a cause of wave on the liquid surface of the plating solution Ps of the plating tank 10. Accordingly, a cause of a liquid splash in the plating solution Ps of the plating tank 10 can be suppressed.

Further, the elevating mechanism 50 in this embodiment may position the substrate holder 30 above the position of the substrate holder 30 in the plating process, when immersing the projecting portion 60 in the plating solution Ps during the air bubble removal. That is, in a case where a ground height of the substrate holder 30 in the plating process is a "first predetermined value," a ground height of the substrate holder 30 during the air bubble removal may be a "second predetermined value" that is higher than the first predetermined value. With this configuration, the projecting portion 60 of the dummy substrate Wfx can be easily suppressed of contacting the ionically resistive element 12 during the air bubble removal.

However, it is not limited to the configuration described above. For example, the elevating mechanism 50 may not position the substrate holder 30 above the position of the substrate holder 30 in the plating process when immersing the projecting portion 60 in the plating solution Ps during the air bubble removal.

After the step S11 in FIG. 7, step S12 is performed. In the step S12, the rotation mechanism 40 rotates the substrate holder 30 in a state where the projecting portion 60 of the dummy substrate Wfx is positioned above the ionically resistive element 12 and the projecting portion 60 of the dummy substrate Wfx is immersed in the plating solution Ps.

Thus, according to the rotation of the substrate holder 30 in the step S12, the dummy substrate Wfx held by the substrate holder 30 rotates, and the projecting portion 60 also rotates. Accordingly, the air bubbles on the lower surface of the ionically resistive element 12 and inside the holes 12*a* (that is, the air bubbles that remain on the ionically resistive element 12) can be suctioned using the pressure difference generated in the peripheral area of the projecting portion 60 of the lower surface Wfa of the dummy substrate Wfx. Thus, the air bubbles that remain on the ionically resistive element 12 can be removed.

Note that, after the step S12 has been performed (that is, after the air bubble removal has been performed), the rotation mechanism 40 stops the rotation of the substrate holder 30, and the elevating mechanism 50 moves up the substrate holder 30, thus positioning the dummy substrate Wfx above the plating solution Ps. Subsequently, the dummy substrate Wfx is removed from the substrate holder 30 (step S13).

With the embodiment as described above, the air bubbles that remain on the ionically resistive element 12 of the plating tank 10 can be removed by performing the step S12 described above. Accordingly, when performing the plating processing on the substrate Wf, the deterioration of the plating quality of the substrate Wf due to the remaining air bubbles can be suppressed.

Figure 8:
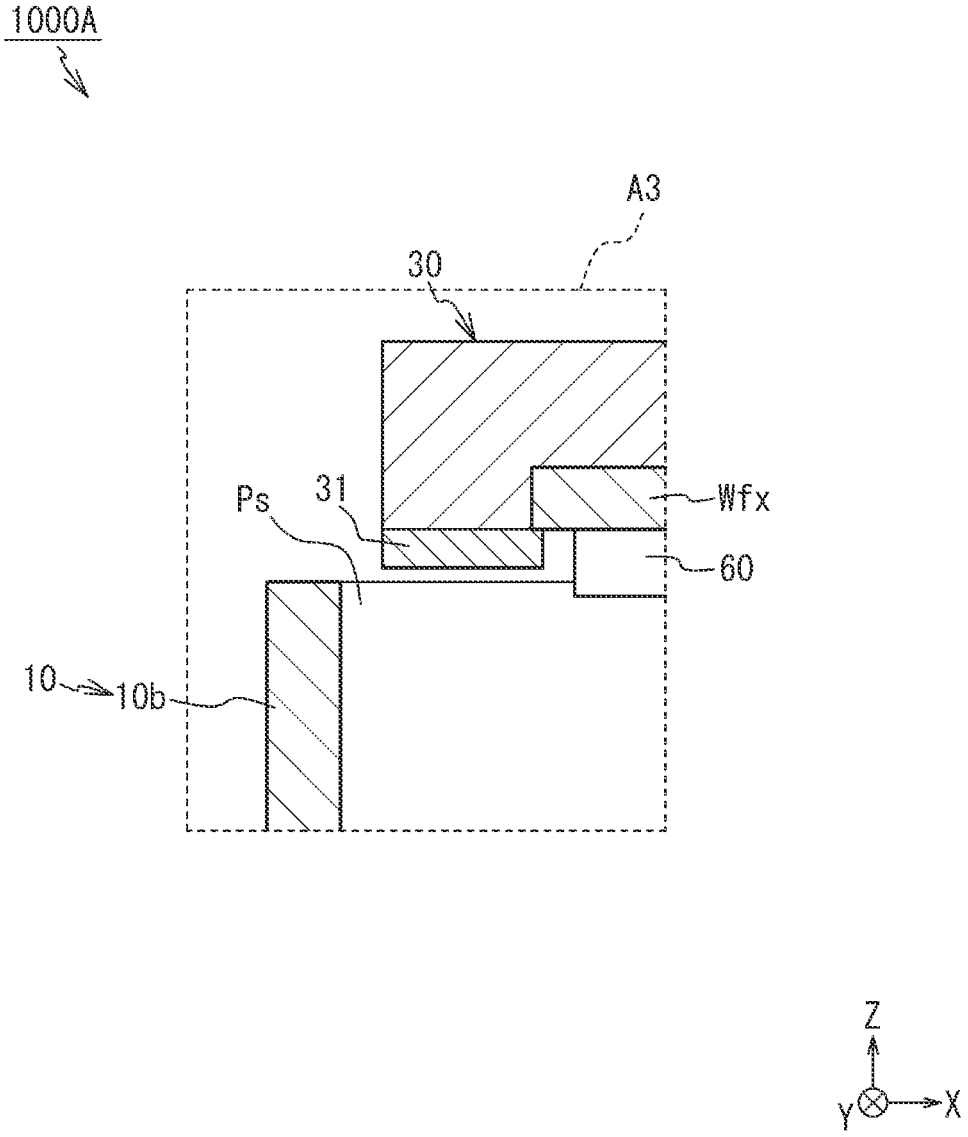
FIG. 8 is an enlarged schematic cross-sectional view illustrating a part of a peripheral configuration of a projecting portion during an air bubble removal of the plating apparatus according to Modification 1 of this embodiment.

[Modification 1 of Embodiment] Note that, during the air bubble removal of the embodiment described above, the part of the lower surface Wfa of the dummy substrate Wfx where the projecting portion 60 is not disposed is also immersed in the plating solution Ps but the configuration is not limited to this. FIG. 8 is an enlarged schematic cross-sectional view illustrating a part (A3 part) of a peripheral configuration of the projecting portion 60 during the air bubble removal of a plating apparatus 1000A according to Modification 1 of the embodiment. As illustrated in FIG. 8, during the air bubble removal, the part of the lower surface Wfa of the dummy substrate Wfx where the projecting portion 60 is not disposed is not necessarily immersed in the plating solution Ps. and only the projecting portion 60 may be immersed in the plating solution Ps.

Even in this modification, similarly to the plating apparatus 1000 according to this embodiment described above, the air bubbles that remain on the ionically resistive element 12 can be removed. Accordingly, when performing the plating process on the substrate Wf, the deterioration of the plating quality of the substrate Wf due to the remaining air bubbles can be suppressed.

Further, in the embodiment and Modification 1 described above, a shape of the projecting portion 60 is not limited to the shape exemplified in FIG. 5. The following describes modifications of the projecting portion 60 (Modification 2 to Modification 6).

Figure 9:
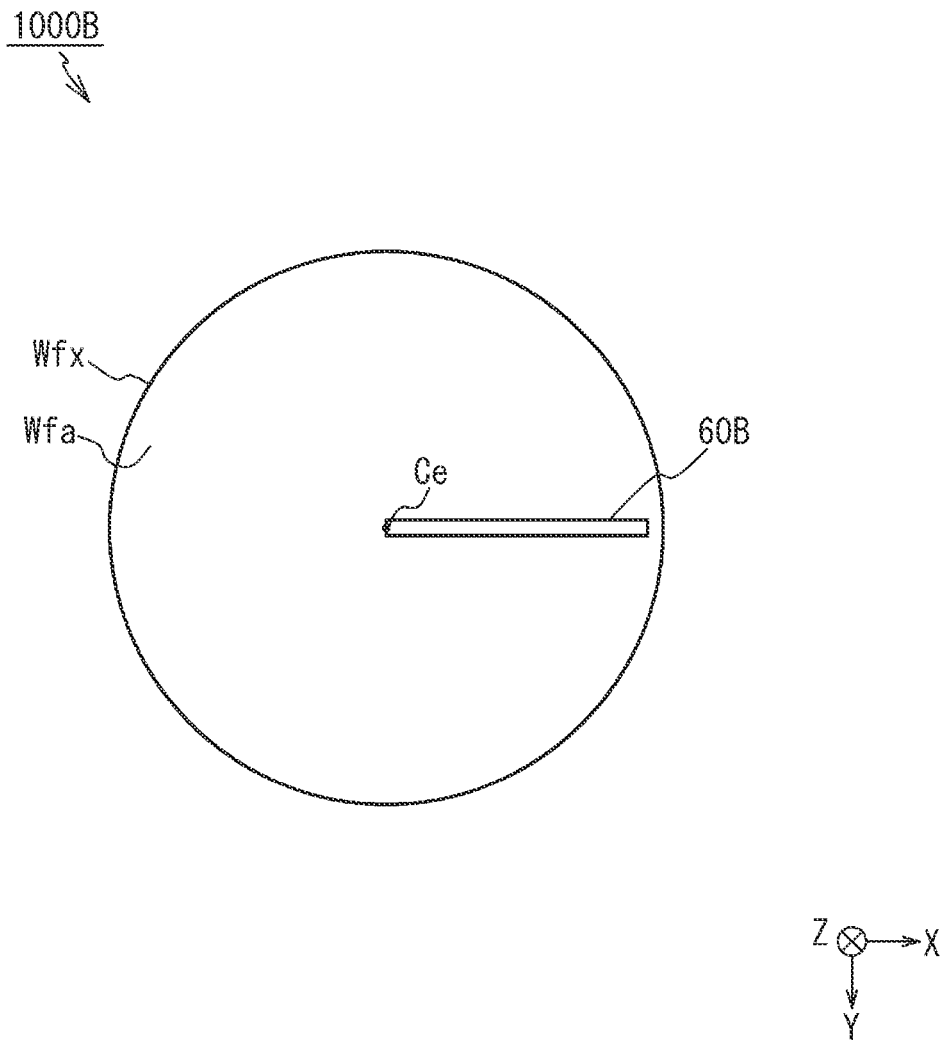
FIG. 9 is a schematic bottom view of a dummy substrate according to Modification 2 of this embodiment.

[Modification 2 of Embodiment] FIG. 9 is a schematic bottom view of the dummy substrate Wfx of a plating apparatus 1000B according to Modification 2 of the embodiment. A projecting portion 60B according to the modification extends only toward one side in the radial direction from the center Ce of the lower surface Wfa (that is, the projecting portion 60B does not extend toward another side in the radial direction). In other words, the projecting portion 60B extends only in the radial direction of the lower surface Wfa of the dummy substrate Wfx. Even in this modification, an operational advantage similar to the plating apparatus 1000 according to the embodiment described above can be provided.

Figure 10:
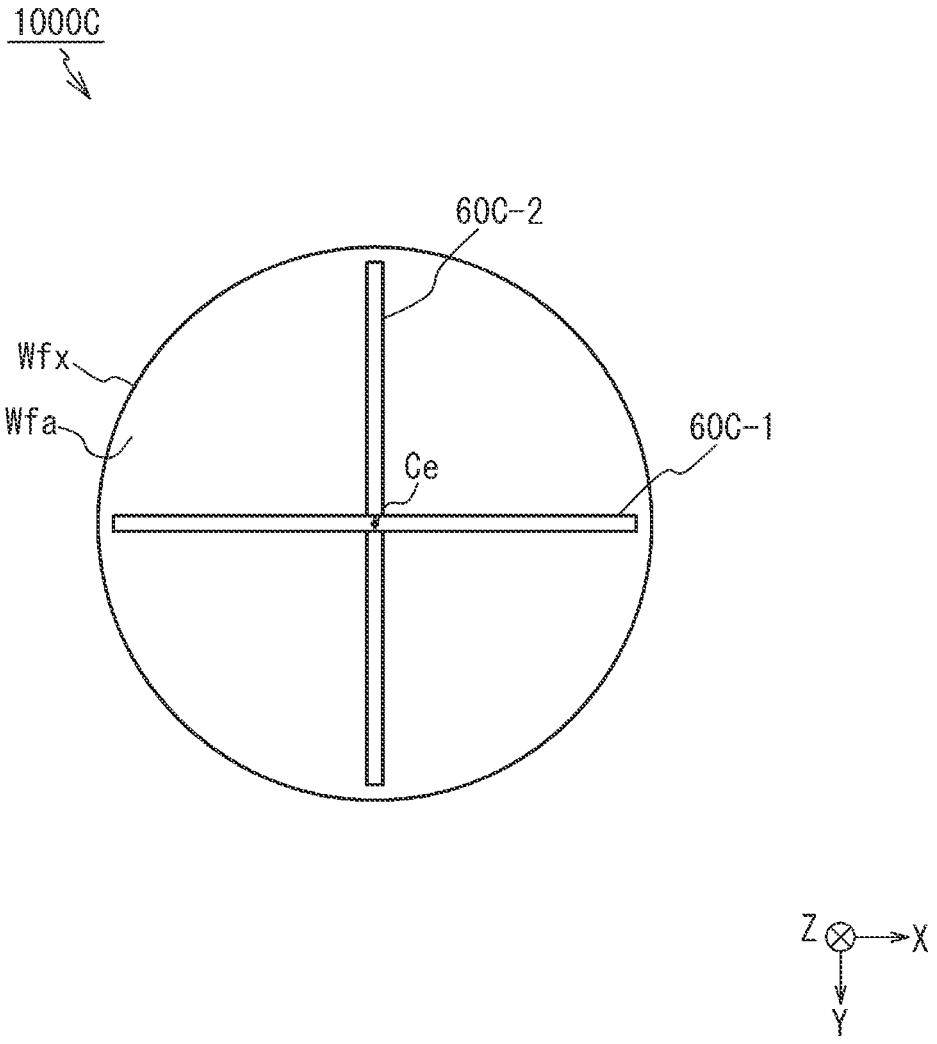
FIG. 10 is a schematic bottom view of a dummy substrate according to Modification 3 of this embodiment.

[Modification 3 of Embodiment] FIG. 10 is a schematic bottom view of the dummy substrate Wfx of a plating apparatus 1000C according to Modification 3 of the embodiment. The dummy substrate Wfx according to this modification has a plurality of projecting portions. A number of the plurality of projecting portions is not particularly limited, and it may be two, three, or four or more. This modification has two projecting portions as an example. Specifically, the plurality of projecting portions according to this modification are a projecting portion 60C-1 and a projecting portion 60C-2.

The projecting portion 60C-1 has a configuration similar to the projecting portion 60 in FIG. 6 described above. On the other hand, the projecting portion 60C-2 intersects with the projecting portion 60C-1 and extends toward one side and another side in a radial direction from the center Ce. That is, the projecting portion 60C-2 has a configuration of the projecting portion 60C-1 copied and arranged (or copied and rotated) in a circular shape. Note that an angle formed by the projecting portion 60C-1 and the projecting portion 60C-2 is not particularly limited, but in this modification the angle is 90 degrees as an example.

Even in this modification, an operational advantage similar to the plating apparatus 1000 according to the embodiment described above can be provided. Further, since the modification has a plurality of projecting portions, compared with a case where there is only one projecting portion, the air bubbles can be suctioned effectively. Accordingly, the air bubbles that remain on the ionically resistive element 12 can be suppressed effectively.

Note that the dummy substrate Wfx according to Modification 2 exemplified in FIG. 9 described above may have a plurality of the projecting portions 60B. That is, the dummy substrate Wfx may have a plurality of the projecting portions 60B extending only toward one side in the radial direction from the center Ce of the lower surface Wfa exemplified in FIG. 9.

Figure 11:
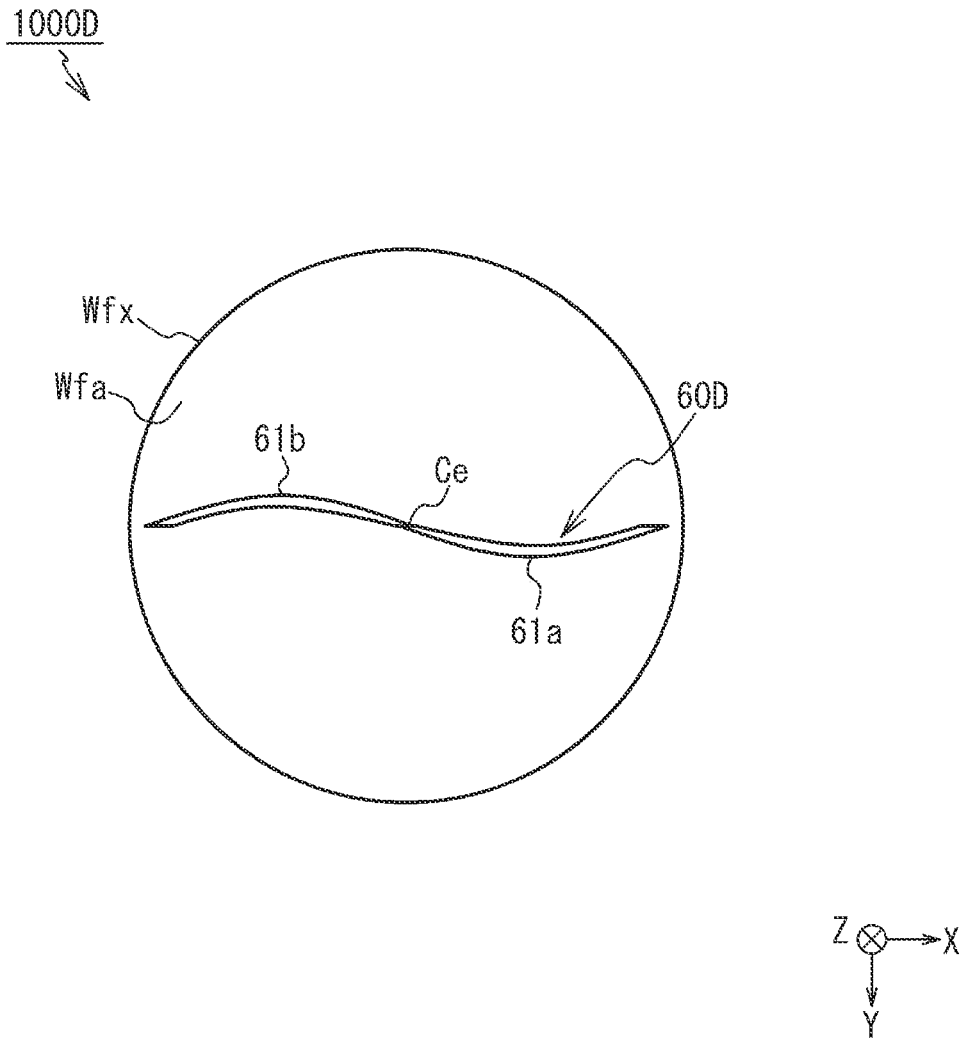
FIG. 11 is a schematic bottom view of a dummy substrate according to Modification 4 of this embodiment.

[Modification 4 of Embodiment] FIG. 11 is a schematic bottom view of the dummy substrate Wfx of a plating apparatus 1000D according to Modification 4 of the embodiment. A projecting portion 60D of the dummy substrate Wfx according to this modification is different from the projecting portion 60 in FIG. 6 in the respect of having a curved portion curved in a circumferential direction of the dummy substrate Wfx in at least a part of the projecting portion 60D. Specifically, the projecting portion 60D according to the modification has a curved portion 61*a* and a curved portion 61*b*.

The curved portion 61*a* is arranged on one side in the radial direction of the lower surface Wfa below the center Ce, and the curved portion 61*b* is arranged on another side in the radial direction of the lower surface Wfa below the center Ce. The curved portion 61*a* and the curved portion 61*b* are curved to project toward the circumferential direction of the lower surface Wfa of the dummy substrate Wfx.

Even in this modification, an operational advantage similar to the plating apparatus 1000 according to the embodiment described above can be provided.

Note that the dummy substrate Wfx according to this modification may have a plurality of the projecting portions 60D.

Figure 12:
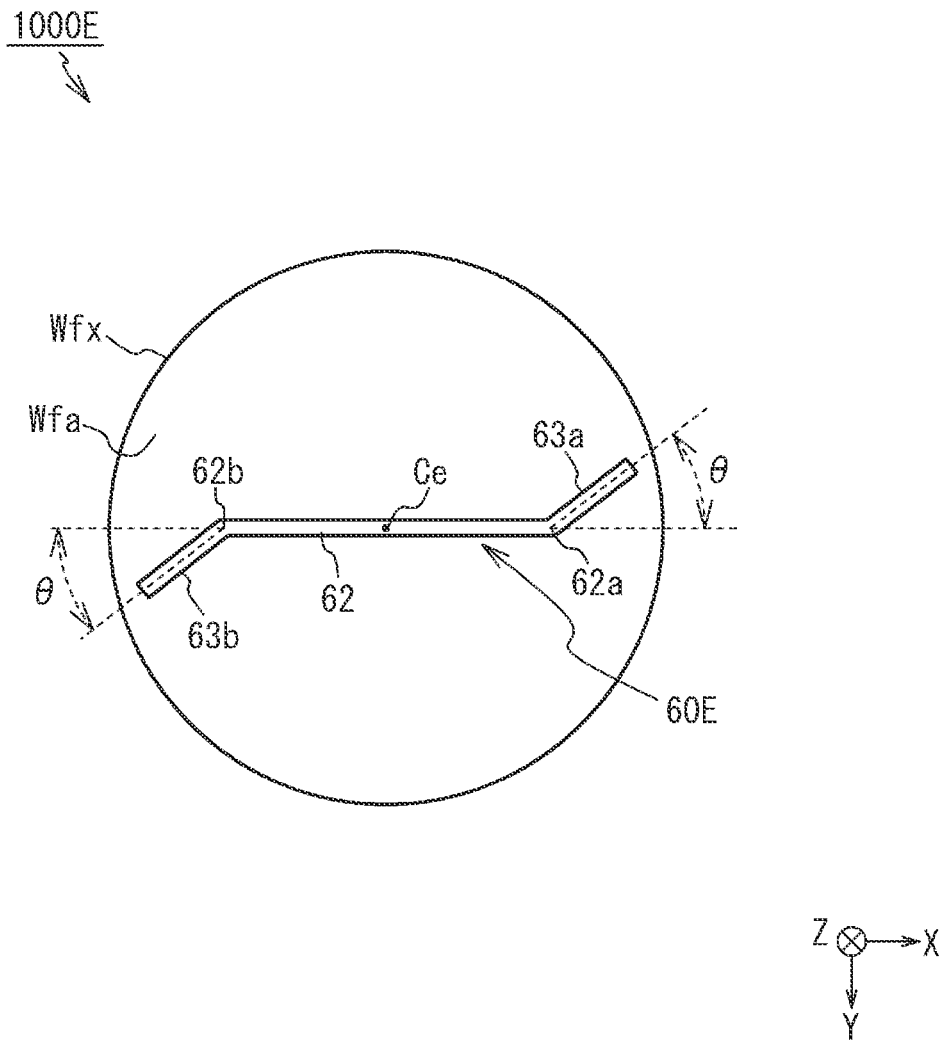
FIG. 12 is a schematic bottom view of a dummy substrate according to Modification 5 of this embodiment.

[Modification 5 of Embodiment] FIG. 12 is a schematic bottom view of the dummy substrate Wfx of a plating apparatus 1000E according to Modification 5 of the embodiment. A projecting portion 60E of the dummy substrate Wfx according to this modification includes a first portion 62 and second portions (second portion 63*a* and second portion 63*b*). The first portion 62 is a portion extending in a radial direction of the lower surface Wfa from the center Ce of the lower surface Wfa of the dummy substrate Wfx toward the outer peripheral edge of the dummy substrate Wfx. Specifically, the first portion 62 according to this embodiment extends to one side and another side in the radial direction of the lower surface Wfa from the center Ce to the outer peripheral edge of the dummy substrate Wfx.

The second portion 63*a* and the second portion 63*b* are portions connected to end portions on the outer peripheral edge side of the first portion 62 and inclined with respect to the first portion 62. Specifically, regarding the end portions on the outer peripheral edge side of the first portion 62 (end portion 62*a* and end portion 62*b*), the second portion 63*a* is connected to the end portion 62*a* on one side, and the second portion 63*b* is connected to the end portion 62*b* on another side.

Note that inclination angles (θ) of the second portion 63*a* and the second portion 63*b* with respect to the first portion 62 are not particularly limited but in this modification the inclination angles are values selected within a range of larger than 0 degree and smaller than 90 degrees. Specifically, the inclination angles are values selected within a range of 10 degrees or more and 45 degrees or less. Further, in this modification, the second portion 63*a* and the second portion 63*b* have the same inclination angle values. However, it is not limited to this configuration, and the inclination angles of the second portion 63*a* and the second portion 63*b* may be different values.

Further, in this modification, the projecting portion 60E includes two second portions (second portion 63*a* and second portion 63*b*) but it is not limited to this configuration. The projecting portion 60E may include only one of the second portion 63*a* and the second portion 63*b*.

Even in this modification, an operational advantage similar to the plating apparatus 1000 according to the embodiment described above may be provided.

Note that the dummy substrate Wfx according to this modification may have a plurality of the projecting portions 60E. For example, the dummy substrate Wfx according to Modification 3 described above (FIG. 10) may include the second portion according to this modification.

Further, the dummy substrate Wfx according to Modification 2 described above (FIG. 9) may include the second portion according to this modification. Even in this case, the dummy substrate Wfx may have a plurality of projecting portions each including the second portion.

Figure 13:
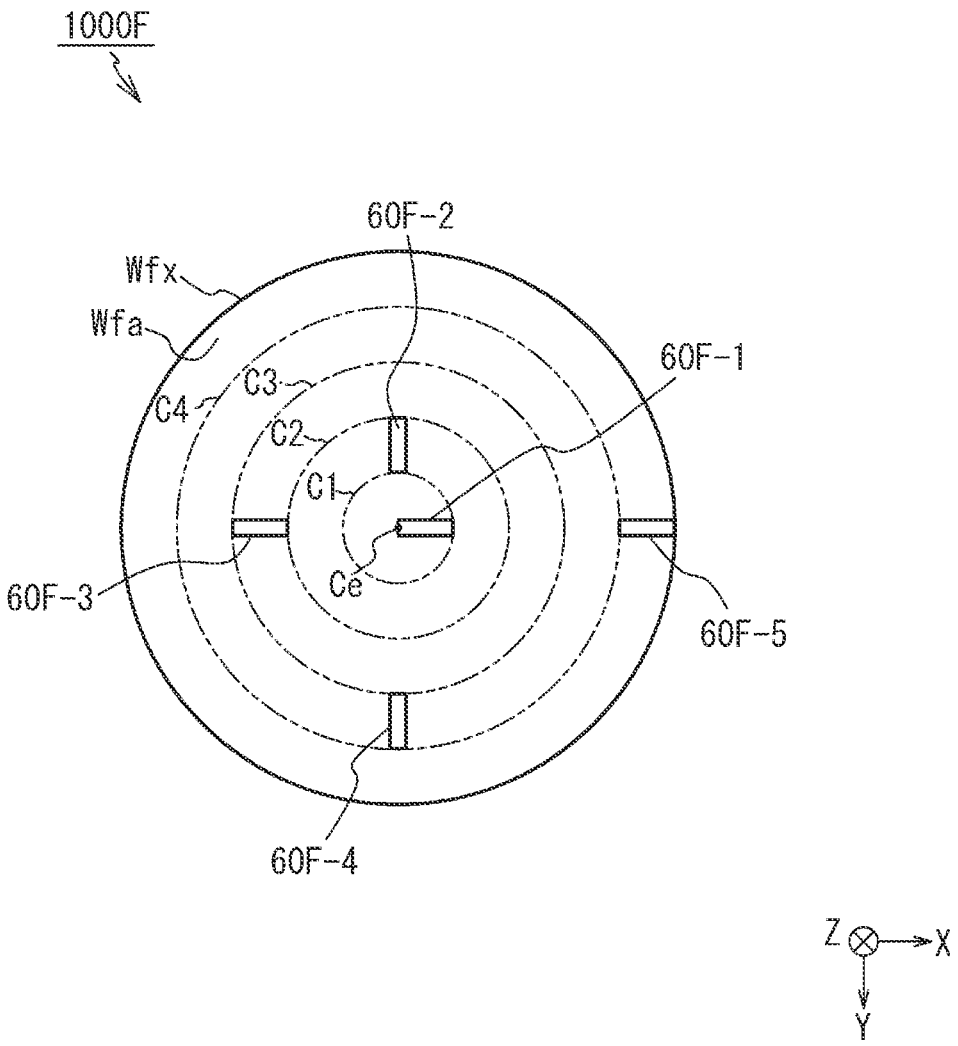
FIG. 13 is a schematic bottom view of a dummy substrate according to Modification 6 of this embodiment.

[Modification 6 of Embodiment] FIG. 13 is a schematic bottom view of the dummy substrate Wfx of a plating apparatus 1000F according to Modification 6 of the embodiment. The dummy substrate Wfx according to this modification has a plurality of projecting portions. Specifically, the plurality of projecting portions according to this modification are a projecting portion 60F-1, a projecting portion 60F-2, a projecting portion 60F-3, a projecting portion 60F-4, and a projecting portion 60F-5.

Further, the plurality of projecting portions according to this modification has a configuration in which in a case where the lower surface Wfa of the dummy substrate Wfx is divided by a plurality of virtual concentric circles (virtual concentric circle C1, virtual concentric circle C2, virtual concentric circle C3, and virtual concentric circle C4), at least one projecting portion is disposed to each region divided by the plurality of virtual concentric circles.

Specifically, the projecting portion 60F-1 is arranged in a region on an inner side of the virtual concentric circle C1, and the projecting portion 60F-2 is arranged in a region between the virtual concentric circle C1 and the virtual concentric circle C2. Further, the projecting portion 60F-3 is arranged in a region between the virtual concentric circle C2 and the virtual concentric circle C3, and the projecting portion 60F-4 is arranged in a region between the concentric circle C3 and the virtual concentric circle C4. The projecting portion 60F-5 is arranged in a region on an outer side of the concentric circle C4.

Further, the respective projecting portions disposed in each region extend in the radial direction of the lower surface Wfa of the dummy substrate Wfx. Regarding a pair of regions adjacent to one another, an angle formed by an extending direction of a projecting portion arranged in one region and an extending direction of a projecting portion arranged in another region is 90 degrees as an example.

Specifically, an angle formed by the projecting portion 60F-1 and the projecting portion 60F-2, an angle formed by the projecting portion 60F-2 and the projecting portion 60F-3, an angle formed by the projecting portion 60F-3 and the projecting portion 60F-4, and an angle formed by the projecting portion 60F-4 and the projecting portion 60F-5 are each 90 degrees.

Even in this modification, an operational advantage similar to the plating apparatus 1000 according to the embodiment described above can be provided.

Note that, in this modification, regarding a pair of regions adjacent to one another, an angle formed by an extending direction of a projecting portion arranged in one region and an extending direction of a projecting portion arranged in another region is not limited to 90 degrees. The angle may be smaller or larger than 90 degrees. Further, in FIG. 13, one projecting portion is disposed to each region divided by the plurality of virtual concentric circles but it is not limited to this configuration. Two or more projecting portions may be disposed to each region divided by the plurality of virtual concentric circles.

Figure 14:
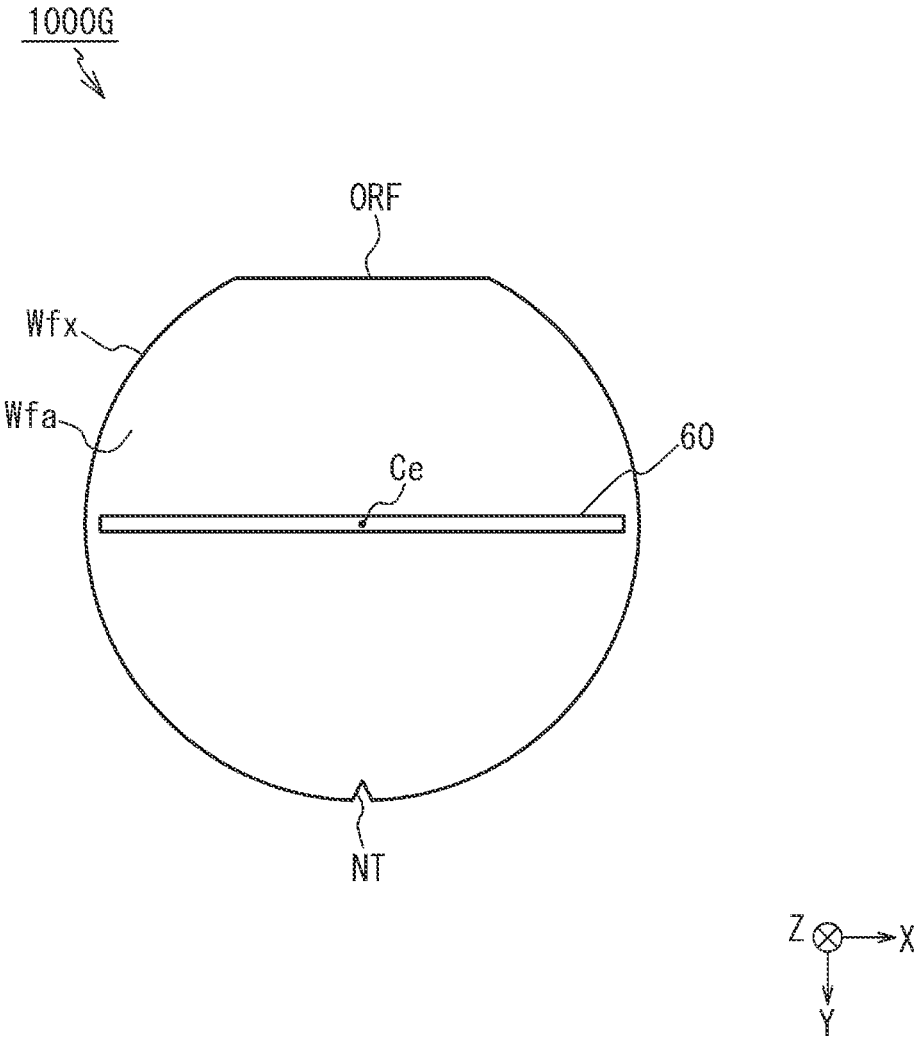
FIG. 14 is a schematic bottom view of a dummy substrate according to Modification 7 of this embodiment.

[Modification 7 of Embodiment] FIG. 14 is a schematic bottom view of the dummy substrate Wfx of a plating apparatus 1000G according to Modification 7 of the embodiment. The dummy substrate Wfx according to this modification is different from the dummy substrate Wfx according to the embodiment exemplified in FIG. 6 in the respect of further including an orientation flat ORF and a notch NT.

Note that a transfer of the dummy substrate Wfx according to this modification may be performed in a method similar to the transfer of the substrate Wf. That is, the transfer mechanism may transfer the dummy substrate Wfx to the location of the substrate holder 30 after the aligner 120 adjusts the positions of the orientation flat ORF and the notch NT of the dummy substrate Wfx in a predetermined direction.

Even in this modification, an operational advantage similar to the plating apparatus 1000 according to the embodiment described above may be provided.

Further, the dummy substrate Wfx according to this modification may include only one of the orientation flat ORF and the notch NT. That is, the dummy substrate Wfx may have a configuration in which the orientation flat ORF is included but the notch NT is not included, or have a configuration in which the notch NT is included but the orientation flat ORF is not included.

Further, the dummy substrate Wfx according to Modifications 2 to 6 described above may include at least one of the orientation flat ORF and the notch NT.

[Modification 8 of Embodiment] In Modifications 1 to 7 described above, whether or not air bubbles exist on the lower surface of the ionically resistive element 12 may be confirmed based on an ultrasonic sound wave transmitted along the lower surface of the ionically resistive element 12 after removing the air bubbles using the dummy substrate Wfx (hereinafter referred to as an "air bubble confirming process"). Specifically, the air bubble confirming process may be performed after the step S12 in FIG. 7 is performed and before the step S13 is performed. The following is a configuration of a plating apparatus 1000H according to the modification.

Figure 15:
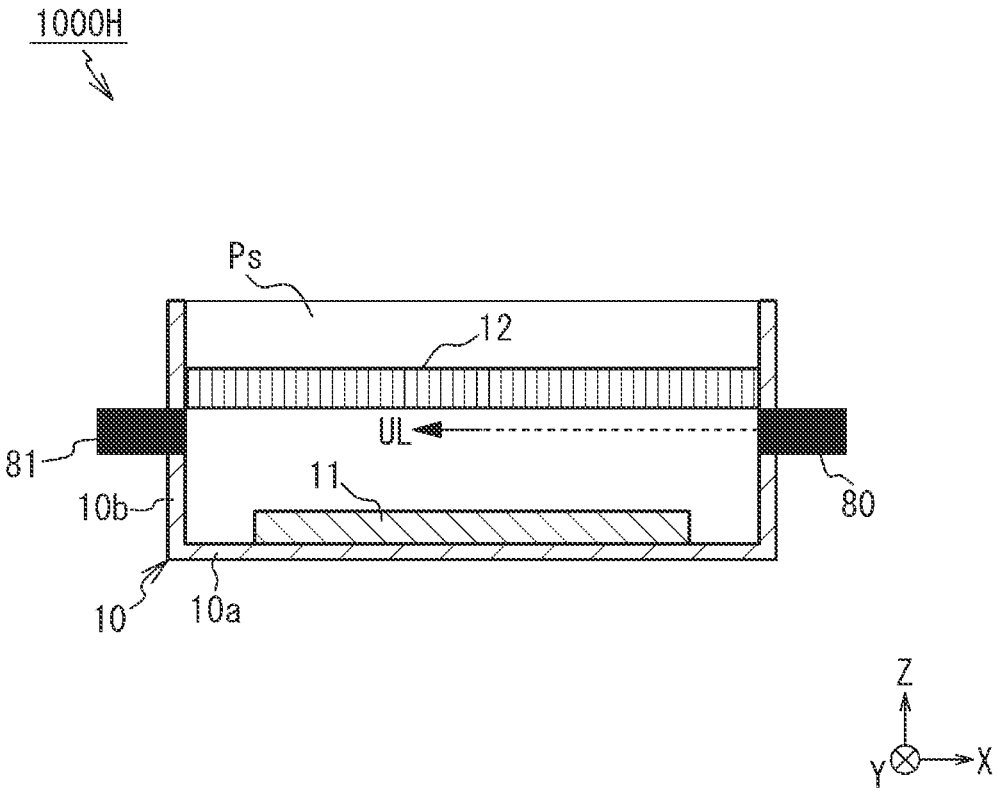
FIG. 15 is a schematic cross-sectional view of a peripheral configuration of a plating tank of a plating apparatus according to Modification 8 of this embodiment.

FIG. 15 is a schematic cross-sectional view illustrating a peripheral configuration of the plating tank 10 of the plating apparatus 1000H according to this modification. Note that, in FIG. 15, illustrations of the overflow tank 20 and the like are omitted. The plating apparatus 1000H includes a transmitter 80 and a receiver 81 in an area below the ionically resistive element 12 in the outer peripheral wall 10*b* of the plating tank 10. The transmitter 80 transmits an ultrasonic sound wave (UL) along the lower surface of the ionically resistive element 12.

The receiver 81 is configured to receive an ultrasonic sound wave transmitted by the transmitter 80. Specifically, the receiver 81 according to the modification is disposed on the outer peripheral wall 10*b* to be opposed to the transmitter 80. The transmitter 80 and the receiver 81 are controlled by the control module 800.

In the air bubble confirming process (that is, when confirming air bubbles), the transmitter 80 transmits the ultrasonic sound wave along the lower surface of the ionically resistive element 12. The receiver 81 transmits received information regarding the ultrasonic sound wave to the control module 800. The control module 800 determines whether or not air bubbles exist on the lower surface of the ionically resistive element 12 based on the ultrasonic sound wave received by the receiver 81.

Specifically, in a case where the ultrasonic sound wave transmitted by the transmitter 80 strikes the air bubbles (air bubbles that exist on the lower surface of the ionically resistive element 12), compared with a case where the ultrasonic sound wave transmitted by the transmitter 80 does not strike the air bubbles and is received by the receiver 81, a strength of the ultrasonic sound wave received by the receiver 81 tends to be weaker. Accordingly, it can be determined whether or not the air bubbles exist on the lower surface of the ionically resistive element 12 based on the strength of the ultrasonic sound wave received by the receiver 81.

Therefore, the control module 800 according to the modification determines whether or not air bubbles exist on the lower surface of the ionically resistive element 12 based on whether the strength of the ultrasonic sound wave received by the receiver 81 is higher or lower than a predetermined value.

Although this embodiment and modifications according to the present invention have been described in detail above, the present invention is not limited to such specific embodiment and modifications, and further various kinds of variants and modifications are possible within the scope of the gist of the present invention described in the claims.

REFERENCE SIGNS LIST

10 . . . plating tank
11 . . . anode
12 . . . ionically resistive element
30 . . . substrate holder
31 . . . ring
40 . . . rotation mechanism

50 . . . elevating mechanism
60 . . . projecting portion
70 . . . space
1000 . . . plating apparatus
Wf . . . substrate
Wfx . . . dummy substrate
Ps . . . plating solution
Bu . . . air bubble
UL . . . ultrasonic sound wave

The invention claimed is:

1. A plating apparatus comprising:

a plating tank configured to accumulate a plating solution and including a porous ionically resistive element arranged in the plating tank;

a substrate holder arranged above the ionically resistive element and configured to hold a dummy substrate;

a rotation mechanism configured to rotate the substrate holder;

an elevating mechanism configured to elevate the substrate holder, and a control module configured to control the rotation mechanism and the elevating mechanism, wherein at least one projecting portion is disposed on a lower surface of the dummy substrate, the at least one projecting portion projecting downward from the lower surface, the substrate holder includes a ring projecting below an outer peripheral edge of the lower surface of the dummy substrate, and the control module is configured to control the elevating mechanism so as to move the substrate holder to a position where the at least one projecting portion of the dummy substrate does not contact the ionically resistive element and the at least one projecting portion is immersed in the plating solution of the plating tank, and to control the rotation mechanism so as to rotate the substrate holder at the position.

2. The plating apparatus according to claim 1, wherein a space is formed between the projecting portion and the ring such that the projecting portion does not contact the ring.

3. The plating apparatus according to claim 1, wherein the projecting portion has a projection height from the lower surface of the dummy substrate, the projection height having a value selected within a range of 1 mm or more and 100 mm or less.

4. The plating apparatus according to claim 1, wherein the projecting portion extends in a radial direction of the lower surface of the dummy substrate.

5. The plating apparatus according to claim 4, wherein the projecting portion has a curved portion curved in a circumferential direction of the dummy substrate in at least a part of the projecting portion.

6. The plating apparatus according to claim 1, wherein the projecting portion includes a first portion extending in a radial direction of the lower surface of the dummy substrate from a center of the lower surface of the dummy substrate toward the outer peripheral edge of the lower surface of the dummy substrate, and a second portion connected to an end portion on the outer peripheral edge side of the first portion and inclined with respect to the first portion.

7. The plating apparatus according to claim 1, wherein when the lower surface of the dummy substrate is divided by a plurality of virtual concentric circles, at least one projecting portion is disposed in each region divided by the plurality of virtual concentric circles.

8. The plating apparatus according to claim 1, wherein the substrate holder is configured to hold a substrate in a plating process to perform a plating process on the substrate and hold the dummy substrate during an air bubble removal to remove air bubbles remaining on the ionically resistive element, and the elevating mechanism is configured to position the substrate holder during the air bubble removal above a position of the substrate holder in the plating process.

9. The plating apparatus according to claim 1, wherein when the elevating mechanism immerses the projecting portion of the dummy substrate in the plating solution of the plating tank, a part of the lower surface of the dummy substrate where the projecting portion is not disposed is also immersed in the plating solution of the plating tank.

10. An air bubble removing method of removing air bubbles remaining on a porous ionically resistive element of a plating tank configured to accumulate a plating solution and including the ionically resistive element arranged in the plating tank, the air bubble removing method comprising:

causing a substrate holder to hold a dummy substrate having a lower surface provided with at least one projecting portion projecting downward;

moving down the substrate holder holding the dummy substrate and immersing the projecting portion in the plating solution of the plating tank in a state where the projecting portion is positioned above and does not contact the ionically resistive element; and rotating the substrate holder in the position above the ionically resistive element.

11. The plating apparatus according to claim 1, further comprising:

a transfer mechanism to transfer the dummy substrate placed in a predetermined placement location to the substrate holder before an air bubble removal to remove air bubbles remaining on the ionically resistive element, wherein the substrate holder is configured to hold a substrate in a plating process to perform a plating process on the substrate and hold the dummy substrate during the air bubble removal, the dummy substrate being transferred by the transfer mechanism before the air bubble removal.

12. The plating apparatus according to claim 1, wherein the rotation mechanism is configured to rotate the substrate holder such that the dummy substrate held in the substrate holder rotates parallel to a top surface of the ionically resistive element.

13. The plating apparatus according to claim 2, wherein a horizontal distance between the projecting portion and the ring is a value selected from a range larger than 0 mm and 1 mm or less.

* * * * *